US005315924A

United States Patent [19]

Kruzick

[11] Patent Number: 5,315,924

[45] Date of Patent: May 31, 1994

[54] WASTE COMPACTOR APPARATUS WITH COMPACTOR AND REMOVABLE SUBJACENT CONTAINER

[75] Inventor: Kent Kruzick, Winamac, Ind.

[73] Assignee: Galbreath Incorporated, Winamac, Ind.

[21] Appl. No.: 879,173

[22] Filed: May 5, 1992

[51] Int. Cl.[5] ..... B30B 15/16; B30B 15/30

[52] U.S. Cl. ..... 100/53; 100/100; 100/229 A

[58] Field of Search ..... 100/100, 53, 229 A, 100/233; 414/406, 408, 421; 312/283, 286

[56] References Cited

U.S. PATENT DOCUMENTS

| | | | |
|---|---|---|---|
| 1,595,263 | 8/1926 | Thornberry | 312/286 X |
| 2,730,421 | 1/1956 | Burst et al. | 312/286 X |
| 3,465,897 | 9/1969 | Schumann et al. | 312/286 X |
| 4,235,165 | 11/1980 | Fenner et al. | 100/229 A X |
| 4,393,767 | 7/1983 | Dutfield | 100/229 A |
| 4,603,626 | 8/1986 | Nall et al. | 100/229 A X |
| 4,804,289 | 2/1989 | Blough | 100/229 A X |
| 4,811,660 | 3/1989 | Robbins | 100/229 A |
| 4,896,593 | 1/1990 | Slusser | 100/229 A X |
| 5,025,721 | 6/1991 | Spiers | 100/229 A |

*Primary Examiner*—Stephen F. Gerrity
*Attorney, Agent, or Firm*—Woodard, Emhardt, Naughton, Moriarty & McNett

[57] ABSTRACT

A waste compactor apparatus having a front, a back and sides, includes a compactor adapted to receive waste materials through an opening in the front and to compress the waste materials into a waste container positioned therebelow; a waste container defining an upwardly facing opening; a support frame supporting the compactor above a channel defined by the support frame, the channel sized for receiving the waste container in a position substantially subjacent the compactor; and, a stop header adapted for variable attachment to the support frame for defining the direction from which the container may be inserted and withdrawn from the channel of the frame.

17 Claims, 5 Drawing Sheets

WASTE COMPACTOR APPARATUS WITH COMPACTOR AND REMOVABLE SUBJACENT CONTAINER

FIELD OF THE INVENTION

The present invention relates to the field of waste handling devices, and more particularly to a waste compactor apparatus with an elevated compactor and cooperating waste container positioned substantially subjacent thereto.

BACKGROUND OF THE INVENTION

To facilitate waste disposal and removal in the most efficient manner possible, many businesses employ a waste compacting unit with a compactor mounted on a support frame and over a container. The compactor receives waste materials through an opening into a receiving chamber and compresses them into the subjacent container. When full or at scheduled times, the container is withdrawn from beneath the compactor by a waste transport vehicle having a pair of forked arms which straddle the sides of and interlock with fork-receiving channels on the container. The vehicle then backs up, pulling the container free from beneath the compactor. The forked arms of the vehicle then pivot to lift the container up, over the vehicle cab, where the contents of the container fall into a waiting trash-receiving chamber mounted to the vehicle.

The compactor of these units generally includes a pivotally supported ram which swings down upon the trash, compressing it both down and to one end of the container. It is therefore a design objective to include a mechanism connected between the container and the compactor support frame to prevent the container from moving while the compacting ram exerts horizontal forces on it. Various designs have been developed to releasably lock the waste container with an associated compacting unit. For example, U.S. Pat. No. 4,804,289 discloses a connector for a refuse container and compactor having a pair of pins extending outwardly from opposite sides of the compactor, the pins adapted to engage with forwardly extending arms with specially shaped notches which cause the container to be pulled into tight engagement with the compactor when the pins enter into notches on the arms. U.S. Pat. No. 5,025,721 discloses an interlocking device for releasably locking a container to its overhead compactor, the device including first and second members formed of flat plates bent along their longitudinal length to form angled sections, one plate being mounted to the compactor and the other plate being mounted in opposing, mirrored fashion to the container. When the container is moved laterally, the plates mutually engage, the container rising and falling as the plate of the container rises up and over the hump of the plate of the compactor. U.S. Pat. No. 4,811,660 discloses a mechanical lock-in device for a front loader compaction assembly, the lock-in device including a vertically reciprocating locking member which is lifted by lifting forks of a collection vehicle when the forks are inserted into the container side pocket, thereby releasing the locking member from engagement with a corresponding bracket on the compactor support frame. Each of these devices, while operable to lock a container with its corresponding compactor without requiring the driver of the waste collection vehicle to leave his cab, each has its own disadvantages in manufacturing costs, reliability, and limitation on overall design of the compactor and container combination.

Another feature of compactors of this nature is the side from which the container is inserted and withdrawn relative to the waste-receiving opening of the compactor. That is, some compactors are mounted flush with the side of a building with the opening to the compactor receiving chamber being inside the building. To empty the container, the waste collection vehicle must engage and withdraw the container from the rear, opposite the side of compactor opening. In other instances, for example, when the compactor and container combination is situated in the corner of a fenced-in lot, refuse is received through a door on the front of the unit, and the container is withdrawn by the waste collection trucks also from the front of the unit. Furthermore, there are a number of different sized waste containers typically available to the user. This requires the supplier to have eight, ten, twelve or even more differently sized and configured compactor/container units to accommodate size and loading/unloading requirements.

What is needed is a vertical compactor assembly which easily provides for varying access requirements and multiple size requirements, and which provides a reliable locking mechanism for securing the container to the compactor during operation.

SUMMARY OF THE INVENTION

Generally speaking there is provided a waste compactor apparatus with an elevated compactor and cooperating subjacent waste container which is adapted for use with variably sized containers, permits insertion and withdrawal of the container from different sides relative to the waste receiving opening of the compactor, and provides a compatible device for interlocking the container and the compactor together during operation.

A waste compactor apparatus having a front, a back and sides, includes a compactor adapted to receive waste materials through an opening in the front and to compress the waste materials into a waste container positioned therebelow; a waste container defining an upwardly facing opening; a support frame supporting the compactor above a channel defined by the support frame, the channel sized for receiving the waste container in a position substantially subjacent the compactor; and, a stop header adapted for variable attachment to the support frame for defining the direction from which the container may be inserted and withdrawn from the channel of the support frame. A container locking assembly is provided in a locking bar mounted to the front of the container and extending outwardly from each side of the container, the locking bar adapted to engage with a pair of ramps mounted to the stop header. Upon complete insertion of the container within the channel, the locking bar engages with and rides up the ramps. Upon reaching the end of the ramps, the locking bar and leading edge of the container fall downwardly to a locked position, holding the container thereat until the leading or front end of the container is lifted up, thereby lifting the locking bar up and clear of the ramps. The support frame of the container includes four vertically extending and telescoping legs which are adapted to be adjusted vertically vary the height of the container receiving channel.

DESCRIPTION OF THE PREFERRED EMBODIMENT

Figure 1:
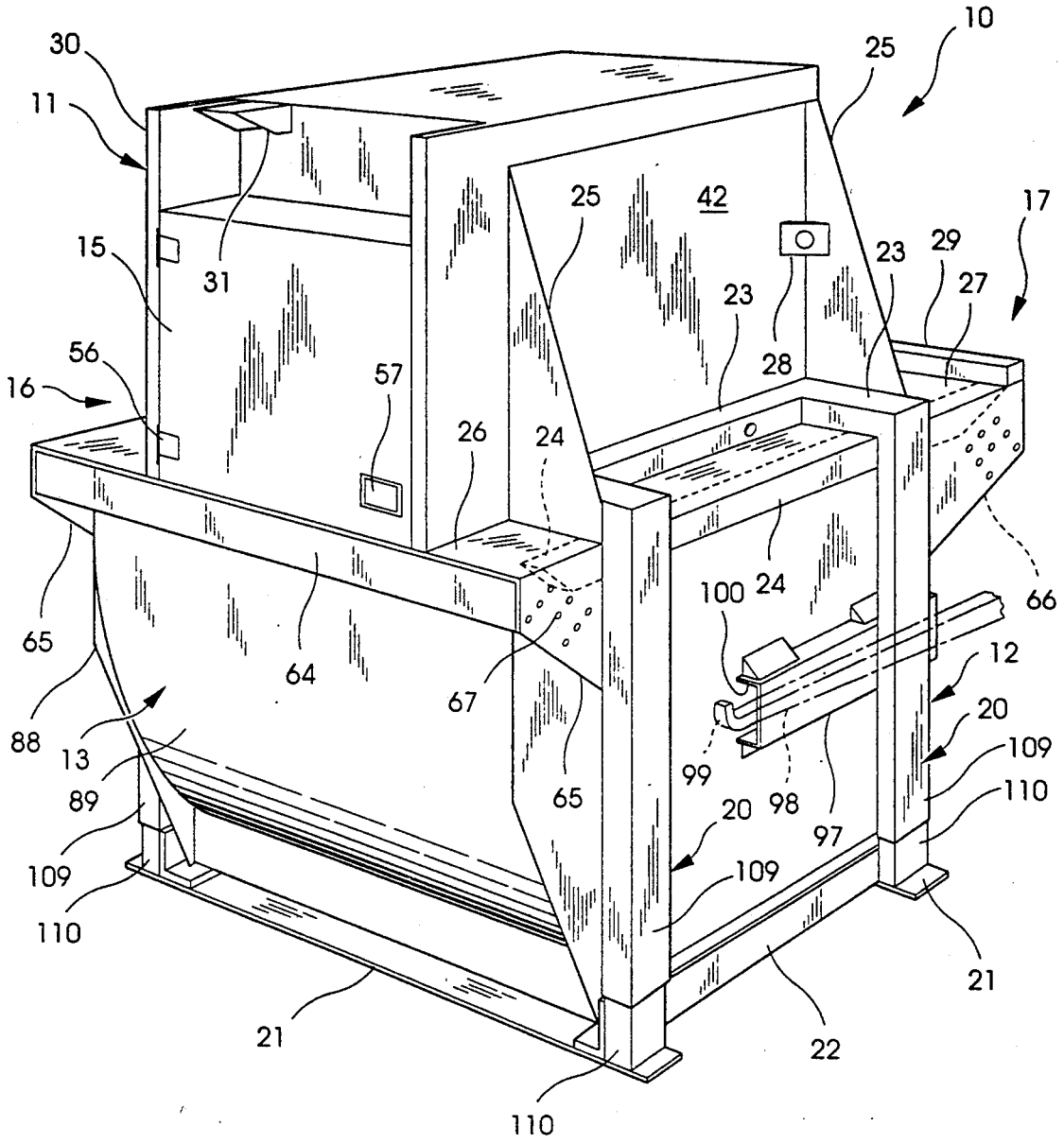
FIG. 1 shows a perspective view of the waste compactor apparatus in accordance with the preferred embodiment of the present invention, the stop header mounted at the front of the support frame.

For the purposes of promoting an understanding of the principles of the invention, reference will now be made to the embodiment illustrated in the drawings and specific language will be used to describe the same. It will nevertheless be understood that no limitation of the scope of the invention is thereby intended, and alterations or modifications in the illustrated device, and any further applications of the principles of the invention as illustrated therein being contemplated as would normally occur to one skilled in the art to which the invention relates.

Figure 7:
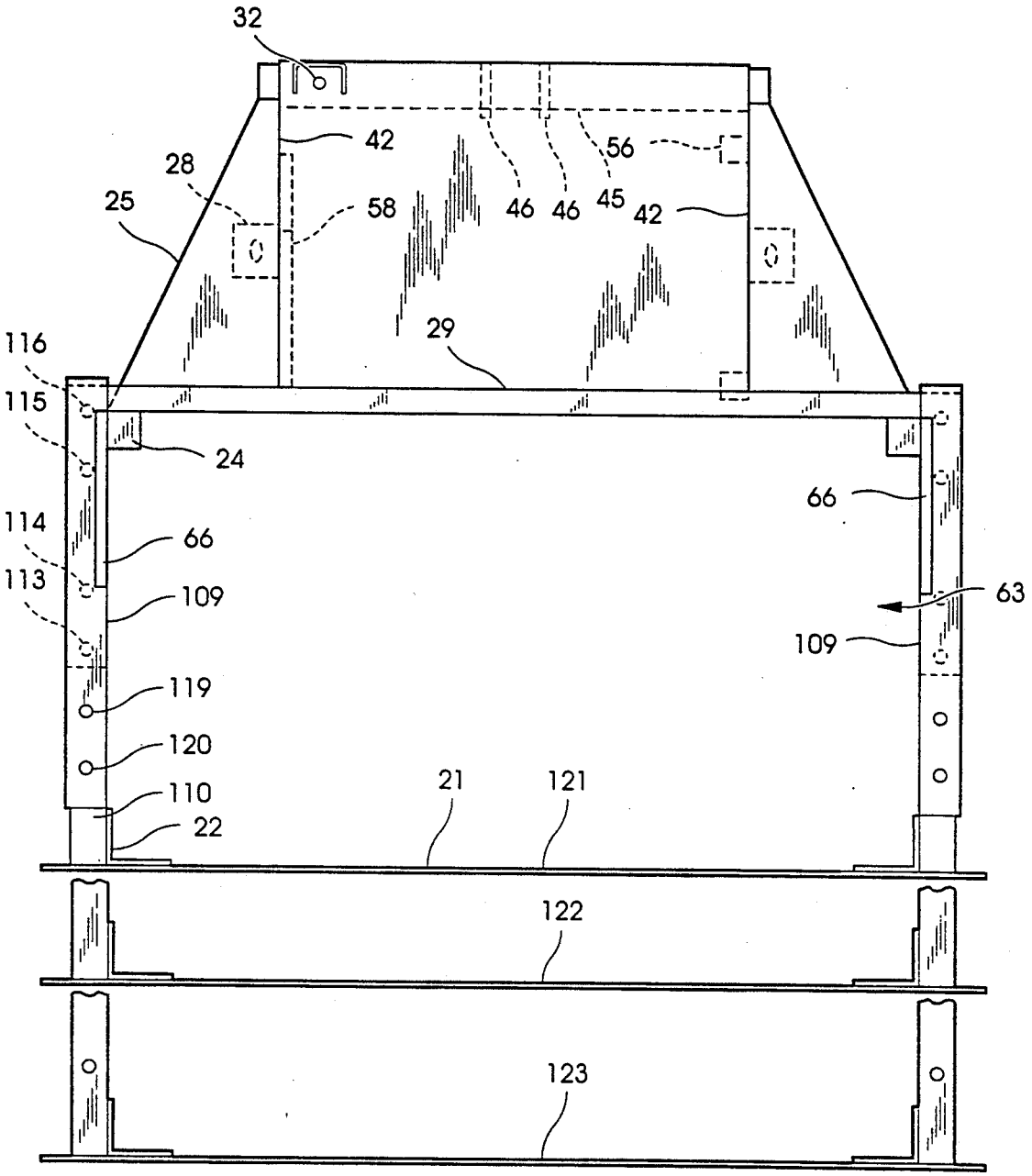
FIG. 7 is a rear elevational view of the compactor and support frame of the vertical compactor of FIG. 1, showing in fragmented form the multiple positions of the telescoping legs.

Referring to FIG. 1, there is shown a waste compactor apparatus 10 in accordance with the preferred embodiment of the present invention. Compactor apparatus 10 includes a compactor 11 supported a variable distance above the ground by a support frame 12. Support frame 12 defines an inverted U-shaped channel for receipt of a waste container 13 thereunder. Apparatus 10 is sometimes referred to as a "vertical compactor." The compactor apparatus 10 shown in FIG. 1 is an "opposite side" vertical compactor. That is, the access door 15 of compactor 11 is on the front side 16 of apparatus 10, while container 13 is withdrawn from and inserted into the back side 17 of apparatus 10. Support frame 12 generally includes four vertically extending, telescopically adjustable legs 20. As described herein, each leg 20 includes an outer tube 109 and an inner, telescoping tube 110. The bottom of the front pair of tubes 110 and the bottom of the back pair of tubes 110 are each fixed as by welding to a laterally extending base plate 21. A longitudinal angle bracket 22 (FIGS. 1 and 7) is secured to the bottom of each side pair of tubes 110 as by welding as shown (FIGS. 1 and 7). Each base plate 21 is preferably secured to the ground by appropriate means such as bolts (not shown). At their upper end, each tube 109 is rigidly secured as by welding to various frame members 23, including a pair of longitudinal frame members 24 which run along the upper opposing side corners of support frame 12. Compactor 11 is then generally secured as by welding to the various frame members 23 and by appropriate additional support devices such as main gussets 25 (welded to compactor 11, frame members 23, front deck 26 and rear deck 27) and corner gussets 28 (secured between compactor 11 and a main gusset 25).

Rear deck plate 27 is mounted atop the longitudinal frame members 24 and spans the width of support frame 12. A bumper bar 29 is mounted atop rear deck plate 27, also spanning the width of support frame 12. Bumper bar 29 helps withstand minor collisions with the front of container 13 when the waste collection vehicle operator is attempting to insert container 13 within support frame 12.

Figure 2:
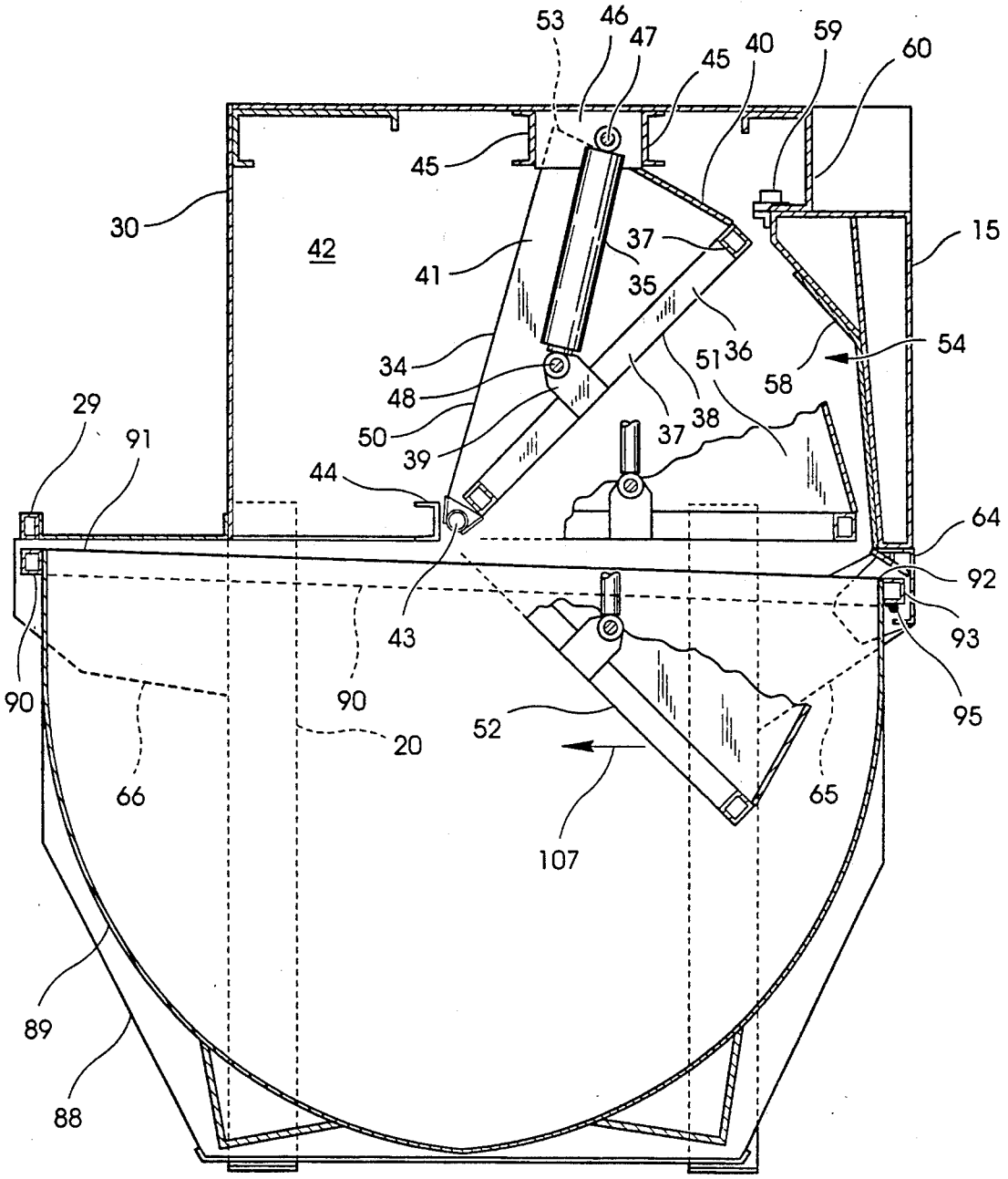
FIG. 2 shows a cross-sectional side view of the vertical compactor of FIG. 1, and shows the three described positions of the ram unit.

Referring to FIGS. 1 and 2, exteriorly, compactor 11 includes a housing 30, a front door 15 and front and rear indicator lights 31 and 32, respectively (FIGS. 1 and 7). Compactor 11 further includes a ram 34 and a ram power unit 35. Ram 34 generally comprises a grid 36 of frame members 37; a ram compression plate 38 secured as by welding to the bottom side of the frame member grid 36; hydraulic cylinder mounting brackets 39 (one shown) secured centrally to grid 36; an end plate 40; and, a pair of opposing side plates (one shown at 41) mounted to opposite sides of grid 36 to sweep along the side walls 42 of housing 30. Ram 34 is supported for pivotal movement within housing 30 by ram axle 43 which is secured to cross beam 44 which extends between and is rigidly secured to inner side walls 42. A pair of support beams 45 span the width of compactor 11 (FIGS. 2 and 7). A pair of spaced apart cylinder mounting brackets 46 are secured as by welding between the support beams 45 midway between side walls 42. Ram power unit 35 is a double-acting hydraulic cylinder and is mounted at one end to cylinder mounting brackets 46 by pin 47 and at its other end to cylinder mounting brackets 39 by a pin 48. A standard hydraulic pressure supply and control unit (not shown) is connected with hydraulic cylinder 35 which may then be engaged to forceably pivot ram 34 between and among a retracted position 50, an intermediate position 51, and an extended position 52. End plate 40, while not shown in its entirety, is a generally rectangular piece with a notch cut out in its upper central portion (at 53) to allow ram 34 to clear cylinder mounting brackets 46. The remainder of end plate 40 comfortably clears the front support beam 45, and ram 34 does not pivot rearwardly enough to be impeded by the rear support beam 45. A receiving chamber 54 is generally defined between inner side walls 42 and below ram 34 when ram 34 is in the retracted position 50. Receiving chamber 54 is open at its bottom and is therefore in communication with the area below compactor 11, specifically, with container 13 when the latter is positioned subjacent to compactor 11 as shown in FIG. 2.

Door 15 is mounted to housing 30 by a pair of hinges 56 and includes a door handle and latch mechanism 57. The inside side of door 15 is angled to define a somewhat curved inner configuration to ensure a smooth trash compression operation as ram 34 sweeps from the retracted position 50 to the intermediate and extended positions 51 and 52. A door stop 58 is provided for door 15 in a narrow, angled flange 58 which is rigidly secured to the inner side wall opposite of hinges 56.

(FIGS. 2 and 7). An appropriate device such as a three-position limit switch (not shown) is mounted to and between housing 30 and ram 34 to provide an electrical signal indicating the relative position of ram 34. In accordance with systems well known in the art, the control unit (not shown) is connected with the limit switch (not shown) and with the hydraulic pressure supply (not shown) to enable easy operation of ram 35 among the three positions 50, 51 and 52. A magnetic limit switch 59 is mounted to and between door 15 and a cross bracket 60. Switch 59 detects when door 15 is properly and completely closed, the output signal thereof being relayed to the above-described control unit (not shown) which will not allow ram 34 to be pivoted unless door 15 is completely closed. A mechanical limit switch is also provided to indicate when container 13 is completely inserted subjacent to compactor 11 as described herein. The output of such limit switch and of front and rear indicator lights 31 and 32 are also connected with the above-described control unit (not shown). Both indicator lights 31 and 32 will be on when ram 34 is in the intermediate position 51 and when container 13 is in the locked or detented position as described below. Lights 31 and 32 thereby signal the driver of the waste collection vehicle both that the container 13 may be withdrawn (since ram 34 is in the intermediate position) or that the container 13 has been fully inserted within support frame 12 (that is, in the detented position).

Figure 3:
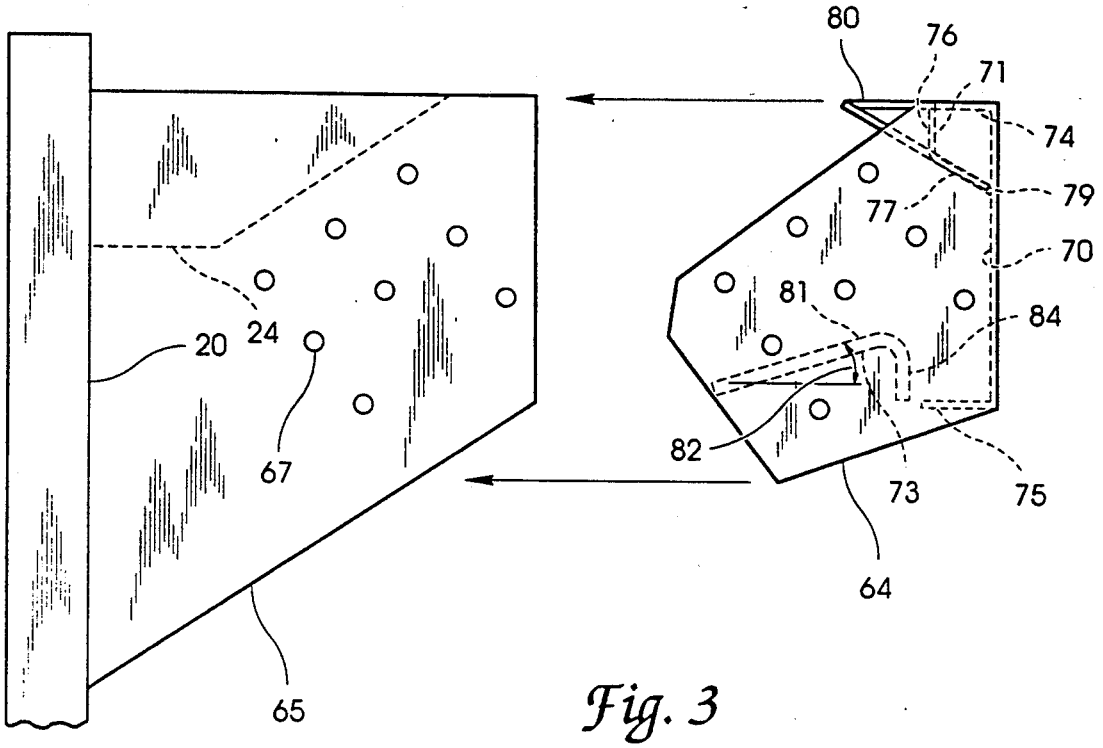
FIG. 3 shows a side view of the interrelationship between the stop header and header bracket of the vertical compactor of FIG. 1.

Referring now to FIGS. 1-7, support frame 12 has an inverted U configuration which defines a passageway 63 sized to receive a container 13. As described above, compactor apparatus 10 of the present embodiment is an opposite side compactor, meaning that compactor access door 15 is on a side opposite where container 13 is inserted and withdrawn. This "opposite side" configuration is determined by placement of a stop header 64, which is changeably secured to front header brackets 65 of support frame 12. Apparatus 10 may be changed to a "same side" configuration by moving header 64 to the rear header brackets 66. Front header brackets 65 are rigidly secured to support frame 12 as by welding to a corresponding leg 20 and the front end of a corresponding longitudinal frame member 24 as shown in FIGS. 1 and 3. Each of header brackets 65 defines a number of mounting holes 67. Rear header brackets 66, while somewhat more elongated than front header brackets 65, are mounted to corresponding rear legs 20 and the back end of longitudinal frame members 24 in a similar manner. Rear header brackets also define a number of mounting holes 67, which are arranged in an identical albeit mirrored arrangement from the holes 67 of header bracket 65.

Referring to FIGS. 3-6, stop header 64 generally comprises a pair of opposing end plates 69, a face plate 70, a pair of angled reinforcing gussets 71, a container guide plate 72, and a pair of opposing ramps 73. Face plate 70 is generally a piece of longitudinal flat stock with two 90° bends forming an upper ledge 74 and a lower ledge 75. End plates 69 are rigidly secured as by welding to the opposite ends of face plate 70 and its upper and lower ledges 74 and 75. Each angled reinforcing gusset 71 is bent at approximately 120° angle thereby forming upper and lower legs 76 and 77, respectively. Gusset 71 is rigidly secured as by welding to the adjacent face plate 70 and corresponding end plates 69 as shown. Angled reinforcing gussets 71 thereby provide an added overall stability to stop header 64. Container guide plate 72 is secured as by welding at 79 to the front flat portion of face plate 70 and at 80 to its upper ledge 74. In one embodiment, each ramp 73 is formed of a piece of flat stock with a bend of approximately 75°. Each ramp 73 is then affixed as by welding to a corresponding end plate 69 so that the ramp surface 81 forms an angle 82 with horizontal of approximately 15°, the remaining drop-off segment 84 oriented near or at vertical, as desired. Each end plate 69 defines a number of holes 85 which match the number and layout of the holes 67 in header brackets 65 and 66. In this configuration, stop header 64 may be removably secured to support frame 12 at the front 16 of container apparatus 10, for example, by sliding header 64 laterally between front header brackets 65 until holes 67 align with holes 85. Appropriate fasteners such as nuts and bolts 86 (FIG. 5) are then attached to rigidly secure header 64 in place. If it is desired to withdraw and insert a container 13 from the front, making compactor apparatus 10 a "same side" vertical compactor, stop header 64 is secured to rear header brackets 66 in a similar manner.

Figure 4:
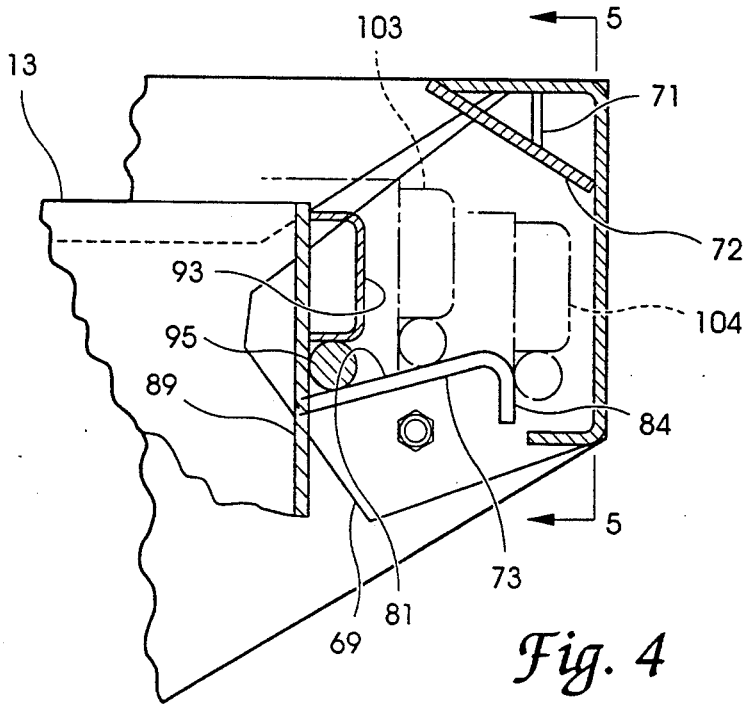
FIG. 4 is a fragmented, side cross-sectional view of the stop header connected with the header bracket of FIG. 3, and shows the progression of the leading end of the compactor as it engages with the stop header.
Figure 5:
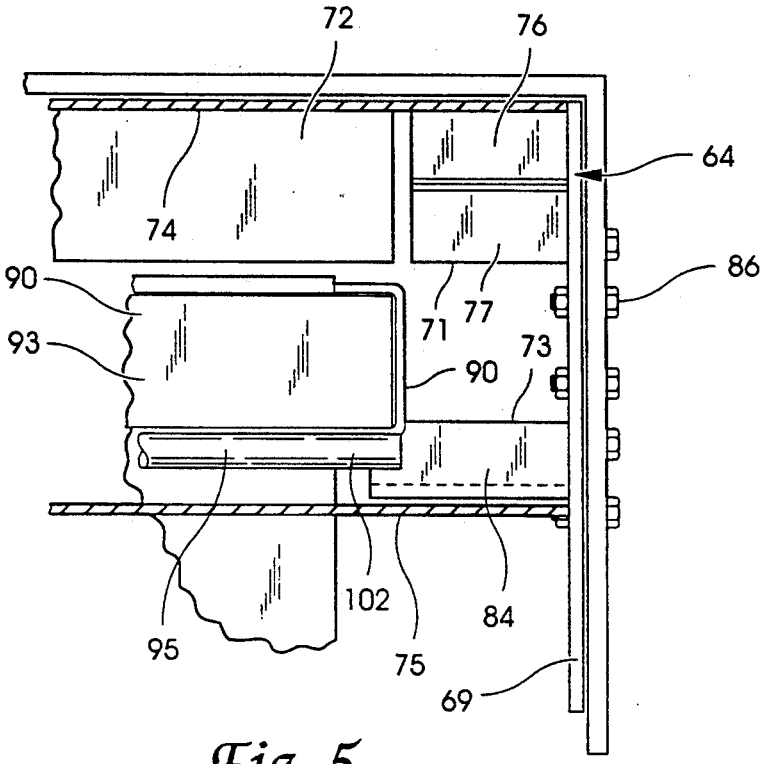
FIG. 5 shows a fragmented, cross-sectional frontal view of the vertical compactor of FIG. 1 taken along the lines 5—5 from FIG. 4 and viewed in the direction of the arrows, the container being in the locked position.
Figure 6:
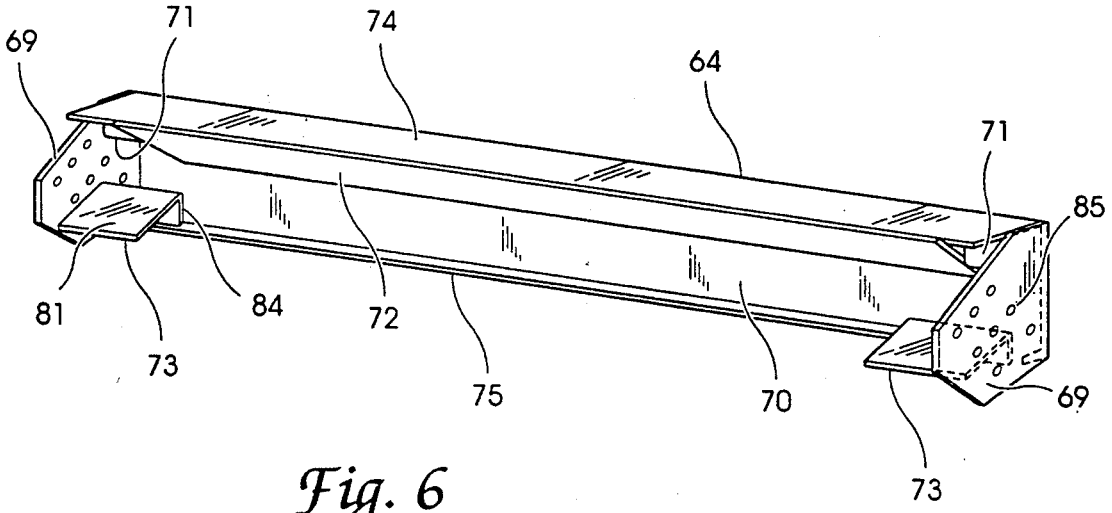
FIG. 6 is a perspective view of the inside of the stop header 64 of the compactor apparatus of FIG. 1.

A container 13 is provided in the present embodiment to receive waste in a compacted fashion from compactor 11 in accordance with the preferred embodiment. Container 13 (FIGS. 1 and 2) generally comprises a pair of flat, shaped side walls 88 and a generally hemicylindrical tub 89 extending therebetween and fixedly secured thereto as by welding. Generally rectangular tube stock 90 surrounds the rectangular perimeter at the top of container 13 to provide strength thereat and to act somewhat as a bumper, thereby helping container 13 to withstand minor collisions during positionment thereof by the waste collection vehicle. For reasons described below, the top of container 13 slopes approximately 2° at a constant rate from its rear 91 toward the front 92. The front or leading length of rectangular tube stock 90 at the the front 92 of container 13 is here defined as the leading bumper 93. A container locking bar 95 is firmly positioned and securely fixed as by welding to the bottom of leading bumper 93 and to hemicylindrical tub 89 as shown in FIG. 4. Bar 95 is thus positioned forwardly of side walls 88 and of the front of container 13; bar 95 is disposed below all of the tube stock members 90; and, the bar extends outwardly of each side wall 88 as shown in FIG. 5.

Finally, tub 13 is provided with a pair of fork receiving channels 97 (one shown in FIG. 1) on the outside of each side wall 88. Channels 97 are well known in the art and are generally adapted to receive therein the two forwardly extending forks (shown in phantom at 98) of a waste collection vehicle. Typically, such forks are advanced through the corresponding channels 97 until the hook end 99 exits the forward end of channel 97, whereupon the forks are pivoted slightly upwardly so that hooked end 99 engages and grasps the leading upper edge 100 of channel 97. Forks 98 may then be withdrawn, pulling container 13 along therewith.

In view of the foregoing description, container apparatus 10 operates as follows:

With header 64 secured, for example, at the front of container apparatus 10 as shown in FIG. 1, door 15 shut, ram 34 in its intermediate position 51, and a container 13 supported upon a pair of forks 98 of a waste collection vehicle (not shown) with the forks 98 tilted 2° or 3°, thereby causing the top rear 91 of container 13 to be approximately level with or below the top front 92, the vehicle advances slowly to move container 13 into passageway 63 (FIG. 7). As container 13 nears the front of support frame 12, the opposing outer ends 102

(one shown in FIG. 5) of locking bar 92 engages with corresponding ramps 73. As container 13 is further advanced, bar 95 follows the ramp surface 81, thereby lifting the front of container 13 as shown in phantom at 103 in FIG. 4. Upon further advancement of container 13, bar 95 eventually reaches and falls off the end of ramp 73, resting just forwardly of drop-off segment 84 as shown in phantom at 104 in FIG. 4. Container is now in the locked position. Only forces directed upwardly on the front of container 13 will lift the front of container 13 and its container locking bar 95 out of its locked position at 104. With container 13 thus fully inserted and in the "detent" and locked position (104) and ram 34 in the intermediate position 51, both front and rear indicator lights 31 and 32 light up, thereby alerting the driver that the container has been successfully inserted. (As stated, front and rear indicator lights 31 and 32 only light when both container 13 is fully inserted and ram 34 is in the intermediate position 51. The control mechanism (not shown) will not allow the ram to be operated when either door 15 is opened or container 13 is not fully inserted. And, the vehicle operator will only withdraw container 13 when indicator lights 31 and 32 are on, which means that ram 34 was in the intermediate position 51. Therefore, while container 13 was being withdrawn and dumped, ram 34 has not been moved, and when the vehicle operator returns container 13 to the fully inserted position, ram 13 is still in the intermediate position at 51 and lights 31 and 32 will light up.)

With container 13 fully inserted and locked as at 104 (FIGS. 2 and 4), ram 34 may be pivoted to the retracted position 50, door 15 may be opened and waste materials inserted into receiving chamber 54. When door 15 is fully closed, sensor 59 will allow operation of ram 34 from the retracted position at 50 down through the extended position at 52. As container 13 begins to fill up, the forced sweeping motion of ram 34 exerts a rearward force component 107 which acts to push container 13 out of channel 63. However, because bar 95 rests in front of drop-off segment 84, container 13 is prohibited from retreating from within support frame 12.

When container 13 is deemed full and with ram 34 activated to rest at the intermediate position at 51, the driver of the waste collection vehicle will see that indicator lights 31 and 32 are on, will advance forks 98 through channels 97 until hooks 99 are cleared of the leading edge 100, will pivot forks 98, thereby pivoting container 13 so that locking bar 95 rises up and clear of drop-off segment 84. The vehicle is then backed up which withdraws container 13 from within support frame 12 and the container is dumped in the usual manner into the collection container of the vehicle.

As container 13 is advanced within channel 63, the vehicle operator may have the container tilted too far, in which case bar 95 does not contact ramp 81. Instead, leading bumper 93 engages with the angularly mounted container guide plate 72 which acts to urge container 13 down to its detented or locked position, such motion providing the vehicle operator with a visual indication that the container has advanced completely.

Figure 8:
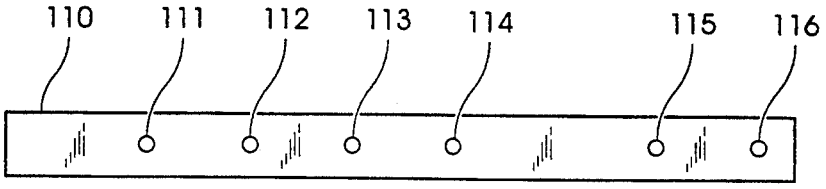
FIG. 8 is a view of one of the leg members of the vertical compactor of FIG. 6 showing the placement of the holes in accordance with the preferred embodiment.

Container apparatus 10 is also adapted to receive a number of differently sized containers. As shown in FIGS. 7 and 8, this is accomplished by forming each leg 20 as a telescoping unit comprising an outer rectangular tube 109 which is affixed as described above to the remainder of support frame 12. Inner telescoping tube 110 is anchored to base plate 21 and angle bracket 22 as described above and is telescopically received within one of the corresponding outer tubes 109. In one embodiment, inner tube 110 has six holes 111–116 extending through the width thereof. Each of the holes 111–114 are six inches apart and holes 115 and 116 are six inches apart. Holes 114 and 115 are twelve inches apart. A pair of holes 119 and 120 are defined six inches apart in the lower portion of each outer rectangular tube 109 to match with a corresponding pair of holes 111–116 in inner tube 110. Inner tube 110 is oriented with hole 111 being at the bottom thereof and closest to base plate 21. With holes 119 and 120 of each outer tube 109 aligned with the lower two holes 111 and 112 of each inner tube 110, support frame 12 is set at its lowest setting indicated by the base plate designated as 121. In this configuration, a container approximately 43 inches high may be inserted within channel 63. Support frame 12 and its attached compactor 11 may be raised by appropriate means such as by the forks of a waste collection vehicle until holes 119 and 120 align with holes 113 and 114 and fasteners are inserted in an appropriate manner. In this configuration, a container approximately 55 inches high may be inserted within channel 63 as indicated by the base plate at 122. Likewise, with holes 119 and 120 aligned with the upper pair of holes 115 and 116, and fasteners appropriately inserted, a container approximately 73 inches high may be installed with channel 63.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A waste compactor apparatus having a front, a back and sides, comprising:

a compactor having a front and defining an opening for receiving waste materials therethrough, the compactor being operable to compress waste materials into a waste container positioned therebelow;

a waste container defining an upwardly facing opening;

a support frame defining a front and a back and a channel open to the front and the back and sized to slidably receive a waste container therein, and wherein said frame supports said compactor above the channel, said support frame including first and second header attachment means at the front and back of said support frame, respectively, for connecting with a stop header; and a stop header interchangeably attachable to either of said first and second header attachment means to block off one of the front and the back of the channel to define the direction from which said container may be inserted and withdrawn from the channel of said frame relative to the opening of said compactor.

2. The waste compactor apparatus of claim 1 further including container locking means for locking said container in a material receiving position below said compactor.

3. The waste compactor apparatus of claim 2 wherein said container locking means includes at least one ramp connected to said header and at least one ramp engaging member extending outwardly from said container, the at least one ramp engaging member configured to engage and lock with said at least one ramp upon insertion of said container into said channel.

4. The waste compactor apparatus of claim 3 wherein said at least one ramp defines a ramp surface and a drop-off segment connected with the ramp surface, the ramp surface and drop-off segment being oriented so that the at least one ramp engaging member engages with the ramp surface before the drop-off segment upon insertion of said container, and wherein the drop off segment forms an angle of nearly 90° with horizontal.

5. The waste compactor apparatus of claim 4 wherein the ramp surface forms angle of about 15° with the horizontal.

6. The waste compactor apparatus of claim 4 wherein said container includes a front, a rear and opposing side walls, and wherein the at least one ramp engaging member includes a bar mounted to the front of the container and extending outwardly of the opposing side walls.

7. The waste compactor apparatus of claim 6 wherein the at least one ramp is a pair of ramps connected to said header and positioned to matingly engage with the at least one ramp engaging member of said container when said header is attached to said support frame.

8. The waste compactor apparatus of claim 2 wherein said container has a front and a rear and a top which slopes downwardly from rear to front.

9. The waste compactor apparatus of claim 2 wherein said compactor includes a housing, a ram and an access door to close the opening, and wherein the waste compactor apparatus further includes a first limit switch assembly operably connected between the door and the housing to preclude pivoting of the ram unless the door is in a closed position.

10. The waste compactor apparatus of claim 9 further including a second limit switch assembly mounted to one of said compactor, said container and said support frame and operable to produce a signal when said container is in a desired position in the channel and subjacent to said compactor.

11. The waste compactor apparatus of claim 2 wherein said support frame includes telescoping legs to vary the size of the channel and, correspondingly, the size of container that the channel can receive.

12. A waste compactor having a front, a back and sides, comprising a compactor having a front and defining an opening in the front for receiving waste materials therethrough, the compactor being operable to compress waste materials into a waste container positioned therebelow;

a waste container defining an upwardly facing opening;

a support frame defining a front and a back and a channel open to the front and the back and sized to slidably receive a waste container therein, and wherein said frame supports said compactor above the channel, said support frame including first and second header attachment means at the front and back of said support frame, respectively, for connecting with a stop header; and a stop header interchangeably attachable to either of said first and second header attachment means and including container locking means for locking said container in a material receiving position below said compactor.

13. The waste compactor of claim 12 wherein said container locking means includes at least one ramp fixed with said header and at least one ramp engaging member extending outwardly from said container, the at least one ramp engaging member configured to engage and lock with said at least one ramp upon insertion of said container into said channel.

14. The waste compactor of claim 13 wherein said at least one ramp defines a ramp surface and a drop-off segment connected with the ramp surface, the ramp surface and drop-off segment being oriented so that the at least one ramp engaging member engages with the ramp surface before the drop-off segment upon insertion of said container, and wherein the drop off segment forms an angle of nearly 90° with horizontal.

15. The waste compactor of claim 14 wherein said container includes a front, a rear and opposing side walls, and wherein the at least one ramp engaging member includes a bar mounted to the front of the container and extending outwardly of the opposing side walls.

16. The waste compactor of claim 15 wherein the at least one ramp is a pair of ramps connected to said header and positioned to matingly engage with the at least one ramp engaging member of said container when said header is attached to said support frame.

17. The waste compactor of claim 12 wherein said container has a front and a rear and a top which slopes downwardly from rear to front.

* * * * *